United States Patent [19]

Cosby et al.

[11] 4,038,130

[45] July 26, 1977

[54] CORRUGATING MACHINE HAVING SELF-ADJUSTING WEB GUIDES

[75] Inventors: James Lynwood Cosby, Parkville; Gordon Lawrence Morgret, Baltimore, both of Md.

[73] Assignee: Koppers Company, Inc., Pittsburgh, Pa.

[21] Appl. No.: 596,407

[22] Filed: July 16, 1975

[51] Int. Cl.[2] ..... B31F 1/00

[52] U.S. Cl. ..... 156/473

[58] Field of Search ..... 156/470–474, 156/205–208, 210

[56] References Cited

U.S. PATENT DOCUMENTS

| | | | |
|---|---|---|---|
| 2,499,267 | 2/1950 | Conner | 156/473 X |
| 3,484,320 | 12/1969 | David | 156/473 |
| 3,630,806 | 12/1971 | Kitajima | 156/472 |
| 3,951,725 | 4/1976 | Bradley | 186/473 |

*Primary Examiner*—David A. Simmons

*Attorney, Agent, or Firm*—Herbert J. Zeh, Jr.; Oscar B. Brumback; Thomas L. Sivak

[57] ABSTRACT

Herein disclosed is a corrugating machine for forming a single-face corrugated paper web from a pair of webs passing therethrough. The corrugating machine comprises a first corrugating roll and a second corrugating roll parallel to and in meshing engagement with the first corrugating roll, the second corrugating roll carries a web of corrugated paperboard material around a portion of the outer periphery thereof. A floating guide continuously urges the corrugated web against the outer periphery of the second corrugating roll and is automatically self-adjusting for compensating for irregularities in the second corrugating roll and the corrugated web. An adhesive roll is in contact with the corrugated web extending around the second corrugating roll for applying adhesive to the tips of flutes on the corrugated web. A pressure roll carrying a facing web on the outer periphery thereof is in contact with the adhesive covered tips of the corrugated web forming the single-face corrugated web.

29 Claims, 7 Drawing Figures

CORRUGATING MACHINE HAVING SELF-ADJUSTING WEB GUIDES

BACKGROUND OF THE INVENTION

1. Field of the Invention

This invention generally relates to surface bonding on an indefinite or running length of flexible web and means for applying a separate web to a shaped web, and more particularly to a single-facer corrugating machine having self-adjusting web guides holding the corrugated web against the corrugating roll.

2. Description of the Prior Art

In the manufacturing of single-face corrugated paperboard, a web of paperboard material is fed from a roll of paperboard material and into a single-facer corrugating machine. Once in the corrugating machine the web of paperboard material is fed around a first corrugating roll having splined teeth running horizontally along the length thereof. A second corrugating roll also having splined teeth along the length thereof is parallel to and in meshing engagement with the splined teeth of the first corrugating roll. The web of material is fed through the nip between the intermeshing splined teeth of the first and second corrugating roll, causing the web of material to deform to the shape of the intermeshing splined teeth, thus forming the corrugations or flutes on the corrugated web. The corrugated web of material travels around the second corrugating roll and an adhesive roll parallel to and adjacent the second corrugating roll applies an adhesive to the tips of the flutes of the corrugated web. A pressure roll parallel to and adjacent the second corrugating roll carries a facing web from a roll of facing material and presses the facing web against the tips of the flutes having adhesive thereon, thus forming single-face corrugated paperboard. The single-faced web is used in forming packaging material or forming double face corrugated paperboard.

In the above operation for manufacturing single-face corrugated paper web the corrugated web must be held in close proximity to the second corrugating roll to prevent the corrugated web and consequently the flutes of the corrugated web from disengaging itself from the second corrugating roll. Should the corrugated web be allowed to become disengaged from the second corrugating roll, fluff out will occur causing blisters in the single-face web which must then be thrown away as scrap. Even with minor fluff out, malformed flutes are produced which reduces the quality of the corrugated paperboard being made. To prevent the corrugated web from becoming disengaged from the second corrugated roll industry has used a plurality of spaced manually adjustable stationary guides extending from approximately the nip between the first and second corrugating rolls and around the second corrugating roll to the nip between the second corrugating roll and the pressure roll. These fixed guides conventionally have a thin strip of metal having an arcuate shape substantially the same as the second corrugating roll in contact with the corrugated web. The thin metal strips are held stationary against the web by conventional rigid supports. These guides hold the corrugated web against the second corrugating roll as the corrugated web travels around the second corrugating roll prior to the web coming in contact with the web on the pressure roll.

The thin metal strips or guide fingers that hold the corrugated web in contact with the second corrugating roll are fixably held in place by means of rigid supports that are bolted to the machine structure members in proximity to the lower corrugating roll. Such rigid supports and guide finger arrangements are shown in Bucker U.S. Pat. No. 2,542,230, A. F. Shields, U.S. Pat. No. 2,711,206, and H. Meister, U.S. Pat. No. 3,346,436. As shown in the above prior art patents, the guide fingers are held stationary by the rigid supports, however, provisions are made to adjust the individual guide fingers, but once adjusted the guide fingers are stationary and nonmovable. Considerable skill is required to properly adjust the guide fingers and since there are a plurality of guide fingers stationed along and parallel to the second corrugating roll, each one of the guide fingers must be individually and manually adjusted to the correct position to insure that the corrugated web is held in close proximity to the second corrugating roll. The manual adjustment by the operator of each individual guide finger takes a considerable amount of time and due to the location of the guide fingers in the single facing machine it is extremely difficult for the operator to reach the adjusting mechanisms. In addition, the adjustment is made more difficult due to the close proximity of the steam heating rollers upon which the operator may be burned.

All the guide fingers must be individually adjusted properly because if the operator adjusts the guide fingers too loosely, fluff out can occur resulting in the disadvantages previously described. Should the operator adjust the guide fingers too tight against the corrugated web, guide finger marks will be formed on the flutes which results in a reduction of the corrugated boards strength. In addition, due to the movements of the machine elements and the heat related expansions and contractions of the various elements in the single-facing machine, the guide fingers will no longer be in proper adjustment because once they are adjusted by the operator they are held stationary and non-movable. Thus, the expansion or contraction of the machinery may cause the corrugated web either to become crushed by the guide fingers or creates poor quality corrugated board due to fluff out. In addition, splices made in the web material, web wrap-ups, or a change in web thickness will cause an increase in web thickness between the guide fingers and the second corrugating roll which may force the guide fingers out of adjustment or in extreme cases will even bend the guides or the second corrugating roll. In the prior art devices, there is provided no means to combine a close guide finger setting and at the same time provide for additional paper accumulation between the guide fingers and the second corrugating roll.

SUMMARY OF THE INVENTION

Accordingly, an object of the present invention is to provide a single-facer corrugating machine that will overcome the aforementioned disadvantages and others. Thus, this invention provides a guide finger which is lightly and continuously urged against the corrugated web on the corrugating roll. In addition, this invention eliminates the need for the operator to adjust the individual guide fingers and readjust them whenever conditions change in the machine by having the guide fingers self-adjusting so they automatically adjust to compensate for machine movement, heat related expansion and contraction of the machine elements, and different thicknesses of corrugated paperboard that pass between the guide fingers and the corrugating roll.

The apparatus for accomplishing the above objects is a corrugating machine for forming single-face corrugated paper web from a pair of webs passing therethrough, comprising: first corrugating roll means; second corrugating roll means in meshing engagement with the first corrugating roll means and carrying a web of corrugated paperboard material around a portion of the outer periphery thereof; floating guide means continuously urging the corrugated web against the outer periphery of the second corrugating roll means and automatically self-adjusting for compensating for irregularities in the second corrugated roll means and the corrugated web; adhesive roll means in contact with the corrugated web for applying adhesive to the tips of flutes on the corrugated web extending around the second corrugating roll means; and pressure roll means carrying a facing web on the outer periphery thereof and in contact with the adhesive covered tips of the corrugated web forming the single-face corrugated web.

The above and further objects and novel features of the invention will appear more fully in the following detailed description when the same is read in connection with the accompanying drawings. It is to be expressly understood, however, that the drawings are not intended as a definition of the invention but are for the purpose of illustration only.

BRIEF DESCRIPTION OF THE DRAWINGS

In the drawings, wherein like parts are marked alike.

DESCRIPTION OF THE PREFERRED EMBODIMENT

Figure 1:
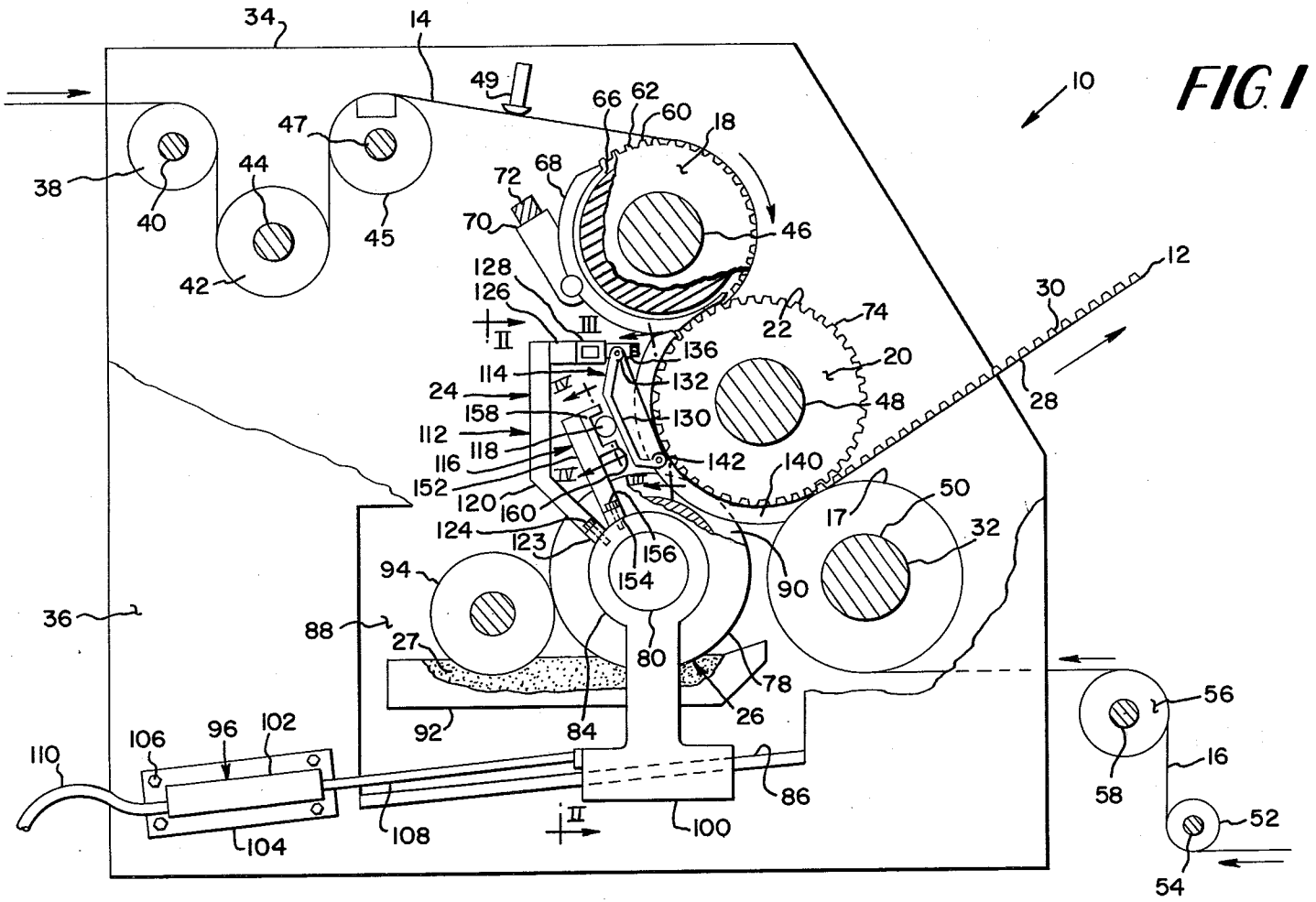
FIG. 1 is a side view in cross section of the single-facer corrugating machine of the present invention showing the preferred embodiment of the floating guide means.

Referring to FIG. 1, the invention generally comprises a corrugating machine, denoted generally by numeral 10, for forming a single face corrugated paper web 12 from a pair of webs 14 and 16 passing therethrough. Corrugating machine 10 generally comprises a first corrugating roll means 18 and a second corrugating roll means 20 in meshing engagement with first corrugating roll means 18 and carrying a web 14 of corrugated paperboard material around a portion of the outer periphery 22 thereof. A floating guide means, denoted generally by numeral 24, continuously urges corrugated web 14 against outer periphery 22 of second corrugating roll means 20 and is automatically self-adjusting for compensating for irregularities in second corrugating roll means 20 and corrugated web 14. An adhesive roll means, denoted generally by numeral 26, is in contact with corrugated web 14 for applying adhesive 27 to tips 28 of flutes 30 on corrugated web 14 extending around second corrugating roll means 20. A pressure roll means 32 carries a facing web 16 on the outer periphery 17 thereof and in contact with the adhesive covered tips 28 of corrugated web 14 thus forming single-face corrugated web 12.

A detailed description of a typical single-facer corrugating machine is given in Moser et al., U.S. Pat. No. 3,390,040. Since the typical single-facer corrugating machine is fully described in the Moser Patent it will not be further described except where necessary to set forth and explain the present invention.

More specifically and referring to the preferred embodiment of FIG. 1, corrugating machine 10 for forming single-face corrugated paper web 12 comprises a pair of support side frames 34 and 36 upon which the various internal parts of corrugating machine 10 are mounted. Generally, in the operation of corrugating machine 10, web 14 of paperboard material is fed between support side frames 34 and 36 and around an idler roll 38 mounted on a shaft 40 which is rotatably connected to support side frames 34 and 36 in bearings (not shown). Web 14 is fed around a preheater roll 42 mounted on a shaft 44 rotatably secured in bearings (not shown) to frames 34 and 36. Preheater roll 42 heats web 14 so that the corrugations may be formed therein. Web 14 then travels around a steamer roll 45 mounted on a shaft 47 non-rotatably secured to side frames 34 and 36. Since steamer roll 45 is non-rotatable, web 14 slides over the surface thereof. The surface of steamer roll 45 below web 14 is perforated and steam is injected into steamer roll 45 in the conventional manner and through the surface perforations and onto web 14. Web 14 is heated and moistened to insure proper flutes are formed. After web 14 leaves steamer roll 45 a plurality of steam jets 49 spaced above web 14 and transverse to the direction of feed steam the top surface of web 14 to insure even moisture content through web 14. Web 14 travels around a first corrugating roll means 18 mounted on a shaft 46 which is rotatably secured in bearings (not shown) to side frames 34 and 36. Web 14 travels between intermeshing first corrugating roll means 18 and second corrugating roll means 20 which is mounted on a shaft 48 rotatably secured in bearings (not shown) to side frames 34 and 36. As web 14 travels between first corrugating roll means 18 and second corrugating roll means 20, web 14 is deformed to form the corrugations or flutes 30. As corrugated web 14 travels around second corrugating roll means 20 floating guide means 24, which is mounted on adhesive roll means 26, continuously and lightly urges corrugated web 14 against the outer periphery 22 of second corrugating roll means 20 so that corrugated web 14 does not become disengaged from second corrugating roll means 20. As corrugated web 14 continues to travel around second corrugating roll means 20, adhesive roll means 26 which is slideably mounted on side frames 34 and 36 transfers adhesive 27 from its outer surface to the tips 28 of flutes 30 of corrugated web 14. Pressure roll means 32 is mounted on a shaft 50 which is rotatably mounted in bearings (not shown) to side frames 34 and 36. A facing web 16 enters between side frames 34 and 36 and travels around idler roll 52 which is rotatably mounted on a shaft 54 secured in bearings (not shown) to supporting structure (not shown) of single-facer machine 10. Facing web 16 travels around preheater roll 56 mounted on a shaft 58 rotatably secured in bearings (not shown) to supporting structure (not shown) of single facer machine 10. Web 16 travels around the outer periphery 17 of pressure roll means 32 and comes in contact with the adhesive covered tips 28 of corrugated web 14 as corrugated web 14 and facing web 16 pass between the nip between second corrugating roll means 20 and pressure roll means 32. The single face web 12 is then fed into adjacent processing machinery (not shown).

Referring to FIG. 1, first corrugating roll means 18 contains a plurality of splined teeth 60 extending along the length of the outer surface 62 thereof. Preferably, splined teeth 60 are rounded on the tips so they do not cut or break through corrugated web 14 as it passes around outer surface 62. First corrugating roll 18 further includes a plurality of circumferentially extending axially spaced grooves 66 on the outer surface 62 thereof.

A plurality of stripper fingers 68 are mounted within grooves 66 by a support member 70 which is secured such as by welding to a support bar 72 extending parallel to first corrugating roll means 18 and is rigidly secured to side frames 34 and 36 such as by welding or bolting (not shown). Stripper fingers 68 extend around first corrugating roll means 18 to the nip between first and second corrugating roll means 18 and 20 and strip and guide web 14 away from first corrugating roll means 18 and onto second corrugating roll means 20 as corrugating web 14 passes between the nip between first corrugating roll means 18 and second corrugating roll means 20 so that corrugated web 14 will travel around second corrugating roll means 20.

Referring again to FIG. 1, second corrugating roll means 20 includes a plurality of splined teeth 74 extending along the length of the outer surface 22 thereof. Preferably, splined teeth 74 are rounded on their ends so that they do not cut or damage corrugating web 14 which contacts outer surface 22 of corrugating roll means 20. Second corrugating roll means 20 is positioned parallel to and adjacent first corrugating roll means 18 so that splined teeth 60 of first corrugating roll means 18 are in meshing engagement with splined teeth 74 of second corrugating roll means 20. Thus, when corrugated web 14 passes between the intermeshing splined teeth 60 and 74 of first corrugated roll means 18 and second corrugating roll means 20 respectively, corrugated web 14 is deformed to form flutes 30.

Referring again to FIG. 1, pressure roll means 32 is mounted between side frames 34 and 36 parallel to and adjacent second corrugating roll means 20. Pressure roll means 32 has a smooth surface 17 which is spaced from second corrugating roll means 20 substantially the same distance as the thickness of corrugated web 14 and facing web 16. Thus, when facing web 16 travels around smooth surface 17 of pressure roll means 32 and corrugated web 14 passes around second corrugating roll means 20, facing web 16 and flutes 30 of corrugated web 14 come in contact with each other at the nip between second corrugating roll means 20 and pressure roll means 32.

Figure 2:
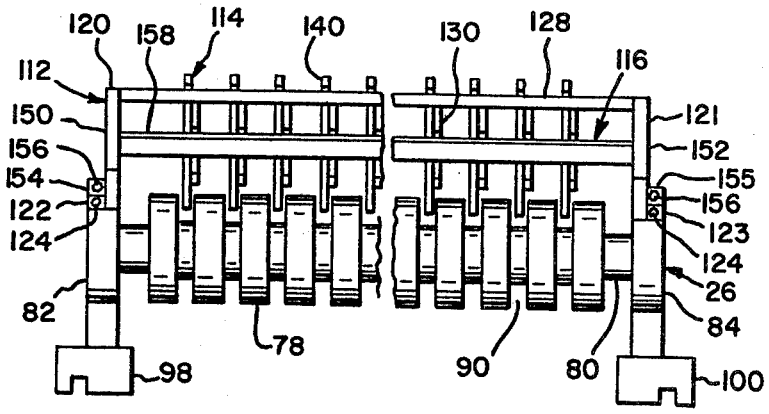
FIG. 2 is an end view of the floating guide means of FIG. 1 taken along the lines II—II showing the grooved adhesive roll rotatably journaled in its mount and the finger numbers extending into the grooves of the adhesive roll.

Referring now to FIGS. 1 and 2, corrugating machine 10 further includes an adhesive roll means 26. Adhesive roll means 26 comprises an adhesive roller 78 which extends parallel to and adjacent second corrugating roll means 20 between first corrugating roll means 18 and pressure roll means 32. Adhesive roller 78 is mounted on a shaft 80 which is rotatably mounted at either end within a pair of bearing mounts 82 and 84. Bearing mounts 82 and 84 are slideably mounted on rails 86 (only one shown) mounted in each side frame 34 and 36. Each side frame 34 and 36 contains an opening 88 (only one shown) on which each rail 86 is formed. Thus adhesive roller 78 can slideably move between side frames 34 and 36 on rails 86. Preferably, rails 86 are sloped downward in the direction away from second corrugating roll means 20. Although rails 86 can be sloped at an angle, it is preferred that they be sloped substantially 15 degrees from the horizontal so that when adhesive roller 78 moves away from second corrugating roll means 20 finger members 140 (to be explained later) will not interfere with splined teeth 74 on second corrugating roll means 20. Adhesive roller 78 further includes a plurality of axially spaced and circumferentially extending grooves 90. The purpose of grooves 90 will be explained later.

Adhesive roll means 26 further includes a conventional adhesive reservoir pan 92 which is mounted in the known manner below adhesive roller 78 so that the bottom portion of adhesive roller 78 rotates within adhesive pan 92. Adhesive reservoir pan 92 contains adhesive 27 that the surface of adhesive roller 78 picks up and places on the tips 28 of flutes 30 of corrugated web 14. A conventional doctor roll 94 is secured in the known manner adjacent adhesive roller 78. Doctor roll 94 smooths out adhesive 27 on the surface of adhesive roller 78 and maintains the correct thickness of adhesive 27 thereon which is required for bonding corrugated web 14 to facing web 16.

Referring again to FIGS. 1 and 2, adhesive roll means 26 further includes an actuator means, denoted generally by numeral 96 which is connected to bases 98 and 100 of bearing mounts 82 and 84. Bases 98 and 100 of bearing mounts 82 and 84 are slideably mounted on rails 86 as previously described. Preferably, actuator means 95 includes a conventional fluid activated cylinder 102 such as, hydraulic or pneumatic, mounted on a support plate 104 which is secured to side frames 34 and 36 such as by bolts 106. A piston 108 connects fluid activated cylinder 102 to bases 98 and 100 such as by bolting or welding. Fluid activated cylinder 102 is connected to a conventional fluid pumping system (not shown) by hose 110. Thus, when fluid activated cylinder 102 is activated, piston 108 will move adhesive roller 78 into contact with corrugated web 14 for applying adhesive 27 thereto and when corrugating machine 10 is stopped or when adhesive roller 78 is to be cleaned, fluid activated cylinder 102 will move adhesive roller 78 away from second corrugating roll means 20. Adhesive roller 78 is moved toward and away from second corrugating roll 20 by bearing mounts 82 and 84 sliding along rails 86.

Referring now to FIGS. 1, 2, 3, and 4, which shows the preferred embodiment for the floating or self-adjusting guide means 24, floating guide means 24 includes a first support means, denoted generally by numeral 112, spaced above adhesive roll means 26 and secured to the ends thereof adjacent second corrugating roll means 20. Floating guide means 24 further includes a plurality of spaced finger guide means, denoted generally by 114, which are pivotably mounted along a portion of first support means 112 above adhesive roll means 26 and in contact with corrugated web 14 extending around second corrugated roll means 20. A second support means, denoted generally by numeral 116, is spaced above adhesive roll means 26 and secured to the ends thereof adjacent finger guide means 114. A resilient means 118 is interposed between second support means 116 and finger guide means 114 for continuously and lightly urging each of the finger guide means 114 independently against corrugated web 14 on second corrugating roll means 20 and for allowing each finger guide means 114 to pivot about first support means 112 so as to remain in contact with corrugated web 14 when finger guide means 114 contacts irregularities in corrugated web 14 and second corrugating roll means 20.

Referring again to FIGS. 1, 2, 3, and 4, first support means 112 includes a pair of support plates 120 and 121 each having a flanged portion 122 and 123 respectively. Each flanged portion 122 and 123 of support plates 120 and 121 are secured respectively to bearing mounts 82 and 84 by bolts 124. Each support plate 120 and 121 extend from bearing mounts 82 and 84 above the outer periphery of adhesive roller 78. Support plates 120 and 121 are formed so that they are spaced from but adjacent second corrugating roll means 20. First support means 112 further includes a spacer bar 126 secured such as by welding to the end of each support plate 120 and 121 and extends inwardly toward corrugating roll means 20. A rigid support tube 128 extends between each spacer bar 126 mounted on support plates 120 and 121 and is secured thereto such as by welding so that support tube 128 extends parallel to and adjacent second corrugating roll means 20.

Figure 3:
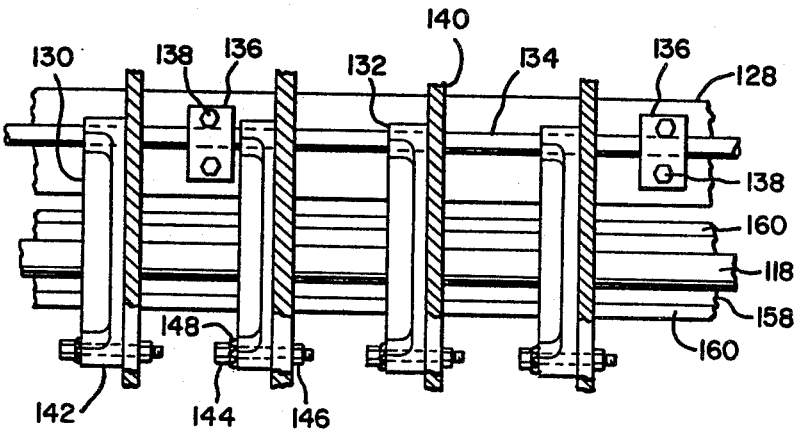
FIG. 3 is an enlarged front view in cross section of the floating guide means of FIG. 1 taken along the lines of III—III showing the manner in which the pivotable members and finger members are pivotably secured to the support structure and showing the resilient means upon which the pivotable members ride.

Referring to FIGS. 1 and 3, finger guide means 114 comprises a plurality of pivotable members 130 spaced along support tube 128 of first support means 112 and are pivotably mounted at one end 132 to support tube 128. Each pivotable member 130 is rotatably mounted at end 132 on a shaft 134 in any known manner such as in bushings or bearings, so that pivotable members 130 will pivot about shaft 134. Shaft 134 is mounted between a plurality of spaced split blocks 136 and split blocks 136 are secured to support tube 128 by bolts 138. Pivotable members 130 are free to slide along the length of shaft 134. Pivotable members 130 are positioned along shaft 134 so they are in substantial alignment with grooves 90 in adhesive roller 78.

Finger guide means 114 further includes a plurality of finger members 140 which have an arcuate shape substantially the same as the peripheral surface of second corrugating roll means 20. The radius of the arc of each finger member 140 is preferably larger than the radius of second corrugating roll means 20 by an amount substantially equal to the thickness of corrugated web 14. Thus, when corrugated web 14 extends around outer surface 22 of second corrugating roll means 20, the entire arcuate surface of each finger member 140 will be in substantial contact with corrugated web 14. Each finger member 140 is mounted at substantially its center to the other end 142 of pivotable member 130 by a shaft bolt 144 pivotably secured in pivotable member 130 by nut 146. Preferably, a wave spring washer 148 is interposed between pivotable member 130 and shaft bolt 144 to insure shaft bolt 144 does not axially shift within pivotable member 130. Thus, when finger member 140 comes in contact with corrugated web 14 it will be able to pivot about pivotable member 130 to insure that the entire arcuate surface is in substantial contact with web 14. Further, each finger member 140 extends from substantially the nip between first and second corrugating roll means 18 and 20 and the nip between second corrugating roll means 20 and pressure roll means 32, thus insuring that corrugated web 14 stays in contact with second corrugating roll means 20. In addition, finger members 140 are made thin enough to enter grooves 90 in adhesive roller 78. Each finger member 140 extends through adhesive roller 78 in grooves 90 since they extend to the nip between second corrugating roll means 20 and pressure roll means 32. Therefore, care must be taken in pivotably mounting pivotable members 130 on shaft 134 to insure each finger member 140 is in alignment with each groove 90 in adhesive roller 78.

Referring to FIGS. 1, 2, 3, 4, second support means 116 includes a pair of support plates 150 and 152, hidden behind support plates 120 and 121 in FIG. 2, having a flanged end 154 and 155 respectively. Each flanged end 154 and 155 of support plates 150 and 152 are secured to bearing mounts 82 and 84 respectively by bolts 156. Preferably, each support plate 150 and 152 is secured to bearing mounts 82 and 84 respectively between second corrugating roll means 20 and first support means 112. Again, it is preferable that each support plate 150 and 152 be positioned between each support plate 120 and 121 respectively and pivotable members 130. Each support plate 150 and 152 extend beyond the surface of adhesive roller 78 so that it is adjacent pivotable members 130. A rigid support trough 158 having sides 160 spans between each support plate 150 and 152 and is secured thereto such as by welding so that rigid trough 158 extends parallel to and adjacent pivotable members 130.

Figure 4:
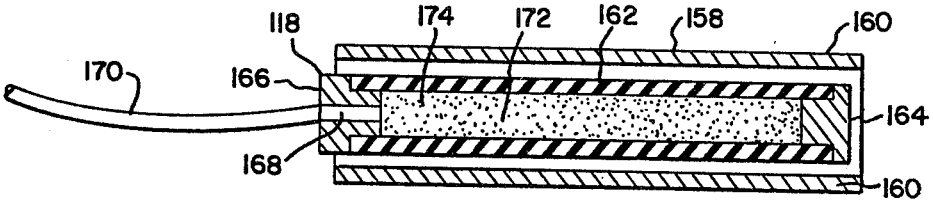
FIG. 4 is an enlarged cross sectional view of the fluid pressurized flexible hose of FIG. 1 taken along the lines of IV—IV showing the pressurized flexible hose within the carrying trough.

Referring now to FIGS. 1, 3 and 4, a resilient member 118 preferably extends the length and within trough 158. The height of resilient member 118 is substantially greater than the sides 160 of support trough 158. In addition, resilient member 18 is in contact with the bottom of trough 158 and in contact with each pivotable member 130. Second support means 116 is secured to each bearing mount 82 and 84 in such a position that resilient member 118 will continuously urge each finger member 140 lightly against corrugated web 14. Thus, resilient means 118 will continuously maintain each finger member 140 in contact with corrugated web 14. In addition, even though the arcuate surface of each finger member 140 may wear it will still remain in contact with corrugated web 14 since resilient member 118 is continuously urging each finger member 140 against corrugated web 14. It is preferred that resilient member 118 comprise a flexible hose 162 which has been pluged at one end by a plug 164. The other end of flexible hose 164 also contains a plug 166. However, plug 166 also contains an opening 168 extending into the interior 174 of flexible hose 162. Opening 168 in plug 166 is connected to a hose 170 which is connected to any conventional liquid pressurizing control system (not shown).

A liquid 172 is pumped from a conventional liquid pressurizing control system (not shown) through hose 170, through opening 168 in plug 166, and into interior 174 of flexible hose 162 to expand flexible hose 162. Preferably, the liquid is air, however, any liquid such as for example, oil, hydraulic fluid, or water may be used to expand flexible hose 162. Once flexible hose 162 is inflated with liquid 172, it wil be in contact between trough 158 and pivotable members 130 and will be compressed a sufficient amount to apply pressure to each pivotable member 130 for continuously urging each finger member 140 lightly against corrugated web 14. Although the above is the preferred manner of making resilient member 118 any material that is resilient may be used to continuously urge finger members 140 against corrugating web 14. An alternative to flexible hose 162 would be a solid resilient rod (not shown), such as rubber, extending the length of trough 158 and having a diameter sufficiently greater than the sides 160 of trough 158 so that the solid rubber bar would be in contact with pivotable members 130. In addition, individual springs (not shown) may be interposed between trough 158 and pivotable members 130 as the resilient member 118. Further, another alternative would be to place individual fluid operated cylinders and pistons (not shown) between trough 158 and each pivotable member 130 to act as resilient member 118.

The above description has illustrated the preferred embodiment for corrugating machine 10 having floating or self-adjusting web guides 24. In the preferred embodiment, the entire floating guide means 24 is rigidly secured to bearing mounts 82 and 84 of adhesive roll means 26. Thus, when corrugating machine 10 is stopped or adhesive roller 78 of adhesive roll means 26 needs to be cleaned adhesive roller 78 is retracted away from second corrugating roll means 20 along rails 86 by actuator means 96. Since both adhesive roller 78 and floating guide means 24 are secured to bearing amounts 82 and 84, the entire floating guide means 24 moves with adhesive roller 78. Since the entire floating guide means 24 moves with the adhesive roller 78, finger members 140 remain within grooves 90 in adhesive roller 78. It is preferred, that finger members 140 remain within grooves 90 to eliminate the problem of having to assure that each finger member 140 lines up with its respective groove 90 when actuator means 96 moves adhesive roller 78 back into position adjacent second corrugating roll means 20. Should finger members 140 not line up exactly with each groove 90 they may become bent or broken which causes unnecessary down time. For this reason, it is preferred that the entire floating guide means 24 be withdrawn with adhesive roller 78.

Figure 5:
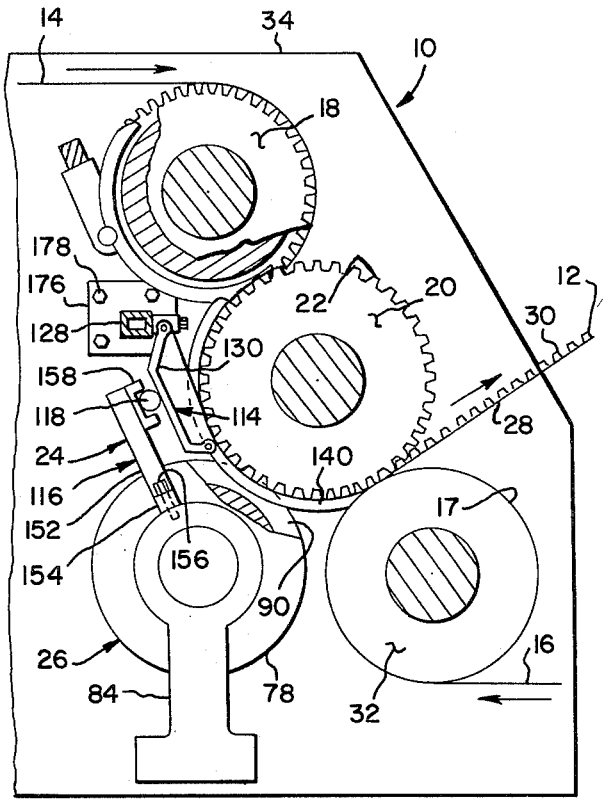
FIG. 5 is a side view of an alternate embodiment of the floating guide means of FIG. 1 showing a part of the support structure for the finger guide means secured to the side frames of the single-facer machine and the outer portion of the support structure secured to the adhesive roll means.

Referring now to FIG. 5, which shows an alternate embodiment to the floating guide means 24 of FIG. 1, only a portion of floating guide means 24 moves with adhesive roller 78 while another portion thereof is rigidly fixed to side frames 34 and 36 of corrugating machine 10. In this arrangement, support plates 120 and 121 and spacer bars 126 are eliminated and support tube 128 is rigidly secured to end frames 34 and 36 of corrugating machine 10. Support tube 128 is secured at each end to a rigid plate 176 (only one shown) such as by welding or bolting and plates 176 are secured to each end frame 34 and 36 by bolts 178. Thus, support tube 128 and consequently pivotable members 130 and finger members 140 are rigidly secured in place and not movable with adhesive roller 78. However, pivotable members 130 are still pivotable about shaft 134 and finger members 140 are pivotable about pivotable members 130. In this arrangement, second support means 116 remains secured to bearing mounts 82 and 84 and are movable with adhesive roller 78 and when adhesive roller 78 is in position adjacent second corrugating roll means 20 resilient means 118 within trough 158 still urges finger members 140 against corrugated web 14.

Figure 6:
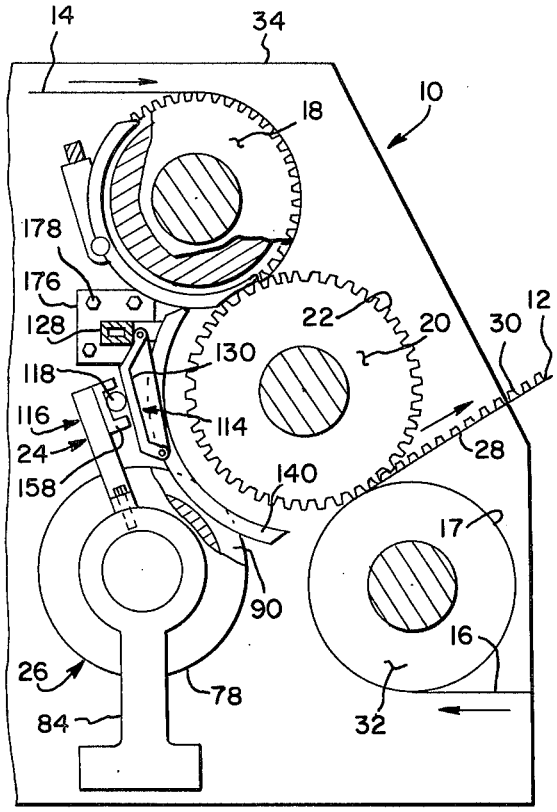
FIG. 6 is a side view of the single-facer machine of FIG. 5 showing the manner in which the finger guide means pivot about the support structure for maintaining its position within the grooves of the adhesive roll when the adhesive roll is moved forward or backward.

As shown in FIG. 6, when adhesive roller 78 is retracted away from second corrugating roll means 20, and consequently trough 158 and resilient means 118, pivotable members 130 connected to stationary support tube 128 pivots around shaft 134 (FIG. 3) and therefore remain in contact with resilient member 118. Since finger members 140 are pivotably connected to pivotable members 130 and thus follow pivotable members 130, finger members 140 will remain within grooves 90 when adhesive roller 78 is moved. It should be pointed out, however, that in this arrangement, there is a maximum point that adhesive roller 78 can be retracted without disengaging finger members 140 from grooves 90 because there is a limit to the rotation of pivotable members 130 about shaft 134. Thus, the operator of the machine must be aware of this limitation to prevent retracting adhesive roller 78 too far.

Figure 7:
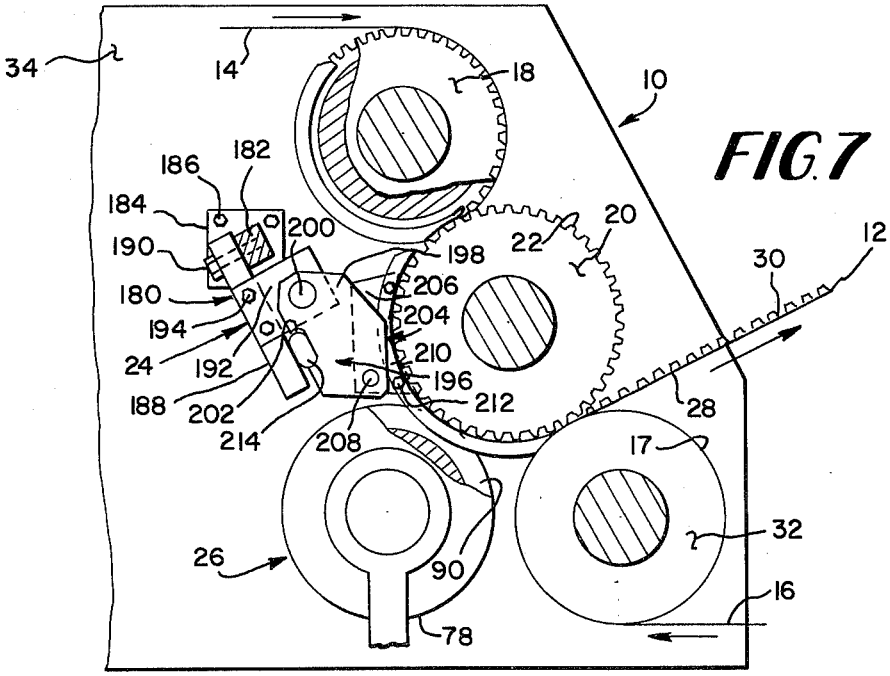
FIG. 7 is a side view of an additional alternate embodiment to the floating guide means of FIG. 1 showing the entire floating guide means secured to the side frames of the single-facer machine.

Referring now to FIG. 7 which shows another alternate embodiment to floating guide means 24, floating guide means 24 in this embodiment is completely separate from adhesive roll means 26. In this arrangement, the entire floating guide means 24 is rigidly secured between end frames 34 and 36 of corrugated machine 10 and thus, when adhesive roller 78 is moved away from second corrugating roll means 20 for cleaning adhesive roller 78, floating guide means 24 remains in place against second corrugating roll means 20 and consequently guide fingers 210 become disengaged from grooves 90 of adhesive roller 78.

Referring again to FIG. 7, floating guide means 24 comprises a support means, denoted generally by numeral 180, which is secured between each side frame 34 and 36 of corrugating machine 10. Support means 180 includes a rigid support bar 182 which extends parallel to and spaced from second corrugating roll means 20. Rigid support bar 182 is secured at each end to a rigid plate 184 (only one shown) such as by welding, and each support plate 184 is rigidly secured to each end frame 34 and 36 by bolts 186. Suppot means 180 further includes a plurality of support members 188 which are rigidly secured at one end to support bar 182 by bolts 190. Each support member 188 is secured to support bar 182 so they are in substantial alignment with each groove 90 in adhesive roller 78. Support means 180 further includes a support plate 192 which is secured substantially to the center of each support member 188 by bolts 194. Support plate 192 extends from support members 188 toward second corrugating roll means 20.

A finger guide means, denoted generally by numeral 196, is pivotably mounted to each support plate 192 and is in contact with corrugated web 14 which extends around second corrugating roll means 20. Finger guide means 196 includes a pair of pivotable members 198 pivotably mounted on either side of support plate 192 by a pivot pin 200. Pivot pin 200 is held in place such as by the use of retaining rings (not shown). Pivotable members 198 include a cut out portion 202 adjacent the bottom of support member 188. Finger guide means 196 further includes a plurality of finger members, denoted generally by numeral 204, which are pivotably mounted between the pair of pivotable members 198 on each support plate 192. Finger members 204 include a pivot plate 206 which is pivotably secured between pivotable members 192 by a pivot pin 208. A guide finger 210 is secured to pivot plate 206 by bolts 212. It should be noted, that the thickness of support plate 192 and consequently the space beween the two pivot members 198 must be sufficient so that pivot plate 206 and guide finger 210 can fit within the space between pivot members 198. Guide finger 210 is preferably a thin strip of metal such as sheet metal or brass, which has an arcuate shape and extends substantially from the nip between first corrugating roll means 18 and second corrugating roll means 20 and to the nip between second corrugating roll means 20 and facing roll means 32. The radius of the arc of each guide finger 210 is preferably larger than the radius of second corrugating roll means 20 by an amount substantially equal to the thickness of corrugated web 14 for the same reasons previously set forth for finger member 140 of the preferred embodiment. In addition, each guide finger 210 is so positioned that it will be aligned with and extend into each groove 90 within adhesive roller 78.

A resilient member 214 similar to resilient member 118 previously described for the preferred embodiment and shown in FIGS. 1 and 4 extends substantially the length of rigid support tube 182 within cut portions 202 in each pivotable member 198. The diameter of resilient member 214 is substantially greater than the depth of cut out portion 202 so that each pivotable member 198 is resting on resilient member 214 and resilient member 214 is resting on support member 188 without pivotable members 198 contacting support members 188. Thus, when resilient member 214 is inflated by a fluid as previously explained it will create an outward pressure on each pivotable member 198 and in turn each guide finger 210 will be lightly urged into contact with corrugated web 14.

In operation, and referring to FIG. 1 illustrating the preferred embodiment, web 14 is fed from a roll of web material, around idler roll 38, around preheater roll 42, steamer roll 45, and below steam jets 49 where web 14 is heated and moistened. Web 14 travels around first corrugating roll means 18 and between the nip between first corrugating roll means 18 and second corrugating roll means 20. As web 14 passes between the intermeshing splined teeth 60 and 74 of first corrugating roll means 18 and second corrugating roll means 20 respectively web 14 is deformed forming flutes 30 to form corrugated web 14. Stripper fingers 68 strip and guide corrugated web 14 from first corrugating roll means 18 and onto second corrugating roll means 20. As corrugated web 14 travels around second corrugating roll means 20 finger members 140 which are continuously urged into light contact with corrugated web 14 by resilient member 118 holds corrugated web 14 against outer surface 22 of second corrugating roll means 20 thus preventing fluff out. Adhesive roller 78 picks up adhesive 27 from within adhesive reservoir pan 92 and doctor roll 94 smooths out adhesive 27 upon the surface of adhesive roller 78 to the correct thickness. Adhesive roller 78 then transfers adhesive 27 to tips 28 of flutes 30 on corrugated web 14. Facing web 16 is fed around roller 52 and preheater roller 56 and onto surface 17 of pressure roll means 32. When facing web 16 comes in contact with the adhesive covered tips 28 of flutes 30 facing web 16 is bonded to tips 28 to form single face corrugating web 12 which continues to the processing equipment.

During the above operation, flexible hose 162 has been inflated and pressurized to the desired pressure by the conventional fluid pressurizing control system so that flexible hose 162 is in contact with trough 158 and pivotable members 130, thus applying light pressure on pivotable members 130 and thereby continuously urging finger members 140 lightly against corrugated web 14 going around second corrugating roll means 20. Resilient member 118 is continuously urging pivotable members 130 and consequently finger members 140 against corrugated web 14 because pivotable members 130 pivot about shaft 134 and finger members 140 pivot about pivotable members 130. Even though finger members 140 will wear due to the friction between finger members 140 and corrugated web 14 no space will be created between them because resilient member 118 will continuously pivot pivotable members 130 about shaft 134 keeping finger members 140 in substantial contact with corrugated web 14. In addition, should an irregularity such as a depression or high point be encountered on the surface of second corrugating roll means 20, each individual finger member 140 will ride over the irregularity by automatically pivoting pivotable member 130 about shaft 134 and against resilient member 118. Thus, no unnecessary strain or stress is imparted to finger members 140. In addition, the same results are obtained should an increase in web thickness be encountered due to splices, wrap-ups, or a new size web. Should an extra thickness of web material be encountered, pivotable members 130 merely pivot about shaft 134 against resilient member 118 moving finger members 140 away from second corrugating roll means 20 but remaining in contact with corrugated web 14. Once the irregularity in second corrugating roll means 20 passes or the splice or wrap-up passes around second corrugating roll means 20 resilient means 118 pivots pivotable member around shaft 134 and holds finger members 140 against corrugated web 14.

When corrugating machine 10 is stopped or adhesive roller 78 is to be cleaned, actuator means 96 is activated which pulls adhesive roller 78 and floating guide means 24 along sloped rails 86 away from second corrugating roll means 20 at preferably a 15° angle so that the tips of finger members 140 at the nip between second corrugating roll means 20 and pressure roll means 32 will not interfere with splined teeth 74 of second corrugating roll means 20. Therefore, since floating guide means 24 moves with adhesive roller 78 finger members 140 will remain within grooves 90 on adhesive roller 78 thus eliminating the need to insure that each finger member 140 is lined up with each groove 90 when adhesive roller 78 is moved into position against web 14 adjacent second corrugating roll means 20.

Referring to FIGS. 5 and 6, the operation of corrugating machine 10 having the alternate floating guide means 24 is exactly the same as previously described for the preferred embodiment of FIG. 1 and therefore will not be described further. However, it should be noted that when retracting adhesive roller 78, finger guide means 114 does not move with adhesive roller 78 but pivots about shaft 134 so that pivotable members 130 remain in contact with resilient member 118 which moves with adhesive roller 78 and finger members 140 remain within grooves 90.

In the operation of corrugated machine 10 as shown in the alternate embodiment of FIG. 7, it is again exactly the same as the operation for the preferred embodiment as shown in FIG. 1 and thus will not be further described. It should be noted, however, that the entire floating guide means 24 remains in contact with corrugated web 14 when adhesive roller 78 is retracted and consequently guide finger 210 willnot remain within grooves 90 of adhesive roller 78. Therefore, when moving adhesive roller 78 back in position adjacent web 14 around second corrugating roll means 20 care must be taken to insure that guide fingers 210 are aligned with grooves 90.

Th foregoing has presented a novel corrugating machine for forming a single-face corrugated paper web. The problem of continuously maintaining the finger members in light contact with the corrugated web traveling around the second corrugating roll has been eliminated by the use of a resilient member which constantly urges the finger members against the corrugated web. The problem of having too much gap between the finger members and the corrugated web which may cause fluff out to occur has been eliminated by the resilient member continuously urging the finger member against the corrugated web. The problem of having to manually adjust the proper position of each of the guide members prior to operation of the machine and the problem of having to readjust each guide member due to each finger member wearing becase of its contact with the web has been eliminated by having each one of the guide fingers individually self-adjusting so that each individual guide member continually adjusts itself to the proper location in relationship to the corrugated web. In addition, the problem of having fixed guide fingers contact irregularities in the second corrugating roll or in the corrugated web itself thus causing damage thereto has been eliminated by having the individual guide members self adjust itself to a new position created by the irregularity in the corrugating roll or the corrugated web. Thus, the problem of damaged finger members caused by irregularities has been eliminated. This self-adjusting feature of the guide members also allows excess corrugated web to enter between the finger members and the second corrugating roll without damaging the finger members or in extreme cases the corrugating roll itself.

Accordingly, the invention having been described in its best embodiment and mode of operation that which is desired to be claimed by Letters Patent is:

1. An improved corrugating machine for forming a single-face corrugated paper web from a pair of webs passing therethrough of the type comprising:

first corrugating roll means;

second corrugating roll means in meshing engagement with said first corrugating roll means and carrying a web of corrugated paperboard material around a portion of an outer periphery thereof;

guide means urging said corrugated web against said outer periphery of said second corrugating roll means;

adhesive roll means in contact with said corrugated web for applying adhesive to the tips of flutes on said corrugated web extending around said second corrugating roll means; and pressure roll means carrying a facing web on an outer periphery thereof in contact with said adhesive covered tips of said corrugated web for forming said single face corrugated web, wherein the improvement comprises an automatically self-adjusting, floating guide means including a support means spaced from said second corrugating roll means and extending parallel thereto;

a plurality of spaced finger guide means pivotably mounted along said support means and in contact with said corrugated web extending around said second corrugating roll means; and a resilient means interposed between said support means and said finger guide means continuously urging each of said finger guide means independently against said corrugated web on said second corrugating roll means and for allowing each of said finger guide means to independently pivot about its pivot point so as to remain in contact with said corrugated web when said finger guide means contacts irregularities in said corrugated web and said second corrugating roll means.

2. The corrugating machine of claim 1 wherein said finger guide means includes a plurality of pivotable members spaced along said support means and pivotably mounted at one end to said support means; and a plurality of finger members having an arcuate shape substantially the same as the peripheral surface of said second corrugating roll means and mounted on the other end of said pivotable members.

3. The corrugating machine of claim 2 wherein each of said finger members are pivotably mounted on each of said pivotable members for maintaining the arcuate surface of said finger member in contact with said corrugated web during pivotable movement of said pivotable members.

4. The corrugating machine of claim 1 wherein said resilient means includes a fluid pressurized flexible hose spanning the length of said support means for supporting said finger guide means thereon.

5. The corrugating machine of claim 4 wherein said flexible hose is pneumatically pressurized.

6. The corrugating machine of claim 1 wherein said floating guide means includes:

a first support means spaced from said second corrugating roll means and extending parallel thereto;

a plurality of spaced finger guide means pivotably mounted along said first support means and in contact with said corrugated web extending around said second corrugating roll means;

a second support means spaced above said adhesive roll means and secured to the ends thereof and adjacent each of said finger guide means; and a resilient means interposed between said second support means and said finger guide means continuously urging each of said finger guide means independently against said corrugated web on said second corrugating roll means and allowing each of said finger guide means to pivot about said first support means so as to remain in contact with said corrugated web when said finger guide means contacts irregularities in said corrugated web and said second corrugating roll means.

7. The corrugating machine of claim 6 wherein said finger guide means includes:

a plurality of pivotable members spaced along said first support means and pivotably mounted at one end to said first support means; and a plurality of finger members having an arcuate shape substantially the same as the peripheral surface of said second corrugating roll means and mounted on the other end of said pivotable members.

8. The corrugating machine of claim 7 wherein each of said finger members is pivotably mounted to each of said pivotable members for maintaining the arcuate surface of said finger members in contact with said corrugated web during pivotable movement of said pivotable members.

9. The corrugating machine of claim 6 wherein said resilient means includes a fluid pressurized flexible hose spanning the length of said second support means for supporting said finger guide means thereon.

10. The corrugating machine of claim 9 wherein said flexible hose is pneumatically pressurized.

11. The corrugating machine of claim 8 wherein said adhesive roll means includes:

a rotatable roller extending parallel to said second corrugating roll means;

a plurality of spaced circumferentially extending grooves extending around the outer periphery of said rotatable roller into which said finger members extend;

an actuator means connected to said rotatable roller for moving said rotatable roller and said second support means toward and away from said second corrugating roll means; and said pivotable members pivotable about said first support means when said actuator means moves said rotatable roller and said second support means for maintaining said finger members within said grooves during said movement.

12. The corrugating machine of claim 6 wherein said second support means includes:

a pair of support plates respectively secured to a non-rotatable portion of each end of said adhesive roll means and extending outwardly beyond the outer periphery thereof; and a rigid trough connected between said pair of support plates above the outer periphery of said adhesive roll means and adjacent said finger guide means, said trough carrying said resilient means therein.

13. The corrugating machine of claim 1 wherein said floating guide means includes:

a first support means spaced above said adhesive roll means and secured to the ends thereof adjacent said second corrugating roll means;

a plurality of spaced finger guide means pivotably mounted along a portion of said first support means above said adhesive roll means and in contact with said corrugated web extending around said second corrugating roll means;

a second support means spaced above said adhesive roll means and secured to the ends thereof adjacent said finger guide means; and a resilient means interposed between said second support means and said finger guide means continuously urging each of said finger guide means independently against said corrugated web on said second corrugating roll means and allowing each of said finger guide means to pivot about said first support means so as to remain in contact with said corrugated web when said finger guide means contacts irregularities in said corrugated web and said second corrugating roll means.

14. The corrugating machine of claim 13 wherein said finger guide means includes:

a plurality of pivotable members spaced along said first support means and pivotably mounted at one end to said first support means; and a plurality of finger members having an arcuate shape substantially the same as the peripheral surface of said second corrugating roll means and mounted on the other end of said pivotable members.

15. The corrugating machine of claim 14 wherein each of said finger members is pivotably mounted to each of said pivotable members for maintaining the arcuate surface of said finger members in contact with said corrugated web during pivotable movement of said pivotable members.

16. The corrugating machine of claim 13 wherein said resilient means includes a fluid pressurized flexible hose spanning the length of said second support means for supporting said finger guide means thereon.

17. The corrugating machine of claim 16 wherein said flexible hose is pneumatically pressurized.

18. The corrugating machine of claim 15 wherein said adhesive roll means includes:

a rotatable roller extending parallel to said second corrugating roll means;

a plurality of spaced circumferentially extending grooves around the outer periphery of said rotatable roller into which said finger members extend; and an actuator means connected to said rotatable roller for moving said rotatable roller and said first and second support means toward and away from said second corrugating roll means, thereby maintaining said finger members within said grooves upon movement of said rotatable roller.

19. The corrugating machine of claim 13 wherein said first support means includes:

a pair of support plates respectively secured to a non-rotatable portion of each end of said adhesive roll means and extending outwardly beyond the outer periphery thereof; and a rigid support member connected between said pair of support plates above the outer periphery of said adhesive roll means and adjacent to said second corrugating roll means upon which said finger guide means are pivotably connected.

20. The corrugating machine of claim 13 wherein said second support means includes:

a pair of support plates respectively secured to a non-rotatable portion of each end of said adhesive roll means and extending outwardly beyond the outer periphery thereof; and a rigid trough connected between said pair of support plates above the outer periphery of said adhesive roll means and adjacent said finger guide means, said trough carrying said resilient means therein.

21. Self-adjusting guide means for a single face corrugating machine, comprising:

a support means spaced from a corrugating roll in said corrugating machine and extending parallel thereto;

a plurality of spaced pivotable members pivotably mounted along said support means;

a plurality of finger guides having an arcuate shape substantially the same as the outer surface of said corrugating roll and pivotably mounted on said pivotable members and in contact with a corrugated web extending around the outer surface of said corrugating roll; and a resilient member interposed between said support means and said pivotable members continuously urging said finger guides against said corrugated web and for allowing each of said pivotable members to pivot about said support means while said finger guides remain in contact with said corrugated web when said finger guides encounter irregularities in said corrugated web and said corrugating roll.

22. Self-adjusting guide means for a single-face corrugating machine, comprising:

a first support means spaced from a corrugating roll in said corrugating machine and extending parallel thereto;

a plurality of spaced pivotable members pivotably mounted along said first support means;

a plurality of finger guides having an arcuate shape substantially the same as the outer surface of said corrugating roll and pivotably mounted on said pivotable members and in contact with a corrugated web extending around the outer surface of said corrugating roll;

a second support means spaced above an adhesive roll means adjacent said corrugating roll and secured to the ends of said adhesive roll means, said support means extending parallel to and adjacent said pivotable members;

a resilient member interposed between said second support means and said pivotable members continuously urging each of said finger guides independently against said corrugated web on said corrugating roll and allowing each of said pivotable members to pivot about said first support means while said finger guides remain in contact with said corrugated web when said finger guides contact irregularities in said corrugated web and said corrugating roll; and said adhesive roll including:

a roller extending parallel to said corrugating roll, a plurality of spaced circumferentially extending grooves extending around the outer periphery of said roller into which said finger guides extend, an actuator means connected to said roller for moving said roller and said second support means toward and away from said corrugating roll, and said pivotable members pivotable about said first support means when said actuator means moves said roller and said second support means for maintaining said finger guides within said grooves during said movement.

23. Self-adjusting guide means for a single-face corrugating machine, comprisng:

a first support means spaced above an adhesive roll and secured to the ends thereof, said first support means and said adhesive roll extending parallel to and adjacent a corrugating roll;

a plurality of spaced pivotable members pivotably mounted along said first support means;

a plurality of finger guides having an arcuate shape substantially the same as the outer surface of said corrugating roll and pivotably mounted on said pivotable members and in contact with a corrugated web extending around the outer surface of said corrugating roll;

a second support means spaced above said adhesive roll and secured to the ends thereof, said second support means extending parallel to and adjacent said pivotable members;

a resilient member interposed between said second support means and said pivotable members continuously urging each of said finger guides independently against said corrugated web on said corrugating roll and allowing each of said pivotable members to pivot about said first support means while said finger guides remain in contact with said corrugated web when said finger guides contact irregularities in said corrugated web and said corrugating roll; and said adhesive roll including;

a roller extending parallel to said corrugating roll, a plurality of spaced circumferentially extending grooves extending around the outer periphery of said roller into which said finger guides extend, and an actuator means connected to said roller for moving said roller and first and second support means toward and away from said corrugating roll, thereby maintaining said finger guides within said grooves upon movement of said roller.

24. The corrugating machine of claim 1 wherein said floating guide means includes:

a first support means and a second support means spaced from said second corrugating roll means and extending parallel thereto;

a plurality of spaced finger guide means pivotably mounting along said first support means and in contact with said corrugated web extending around said second corrugating roll means; and a resilient means interposed between said second support means and said finger guide means continuously urging each of said finger guide means independently against said corrugated web on said second corrugating roll means and allowing each of said finger guide means to pivot about said first support means so as to remain in contact with said corrugated web when said finger guide means contacts irregularities in said corrugated web and said second corrugating roll means.

25. The corrugating machine of claim 24 wherein said finger guide means includes:

a plurality of pivotable members spaced along said first support means and pivotably mounted at one end to said first support means; and a plurality of finger members having an arcuate shape substantially the same as the peripheral surface of said second corrugating roll means and mounted on the other end of said pivotable members.

26. The corrugating machine of claim 24 wherein each of said finger members is pivotably mounted to each of said pivotable members for maintaining the arcuate surface of said finger members in contact with said corrugated web during pivotable movement of said pivotable members.

27. The corrugating machine of claim 24 wherein said resilient means includes a fluid pressurized flexible hose spanning the length of said second support means for supporting said finger guide means thereon.

28. The corrugating machine of claim 27 wherein said fluid pressurized flexible hose is positioned in a rigid trough means connected to said second support means and spanning the length thereof.

29. The corrugating machine of claim 27 wherein said flexible hose is pneumatically pressurized.

* * * * *